United States Patent [19]

Solomon

[11] 4,222,190

[45] Sep. 16, 1980

[54] DEVICE FOR HOLDING FLIP CARDS

[75] Inventor: Jack Solomon, Long Beach, N.Y.

[73] Assignee: Oxford Pendaflex Corporation, Garden City, N.Y.

[21] Appl. No.: 928,392

[22] Filed: Jul. 27, 1978

Related U.S. Application Data

[63] Continuation-in-part of Ser. No. 873,090, Jan. 27, 1978.

[51] Int. Cl.[3] ..... G09F 19/00

[52] U.S. Cl. ..... 40/530; 40/389; 402/75

[58] Field of Search ..... 40/530, 535, 536, 401, 40/402, 404, 389; 281/15; 402/74, 75

[56] References Cited

U.S. PATENT DOCUMENTS

| | | | |
|---|---|---|---|
| 196,776 | 11/1877 | Beck | 40/530 |
| 669,326 | 3/1901 | Oberteufer | 40/530 |
| 1,104,711 | 7/1914 | Shepard | 40/536 |
| 1,471,481 | 10/1923 | Goberdiel | 40/535 |
| 1,691,049 | 11/1928 | Douglas | 40/530 |
| 2,889,937 | 6/1959 | Best | 40/536 |
| 2,960,781 | 11/1960 | Olson | 40/389 |
| 3,136,082 | 6/1964 | Sloves | 40/530 |
| 3,286,382 | 11/1966 | Newman | 40/156 X |
| 3,638,967 | 2/1972 | Mullins | 402/75 X |

*Primary Examiner*—Gene Mancene
*Assistant Examiner*—Wenceslao J. Contreras
*Attorney, Agent, or Firm*—Darby & Darby

[57] ABSTRACT

A device for holding flip cards is disclosed. The device includes a cover which is hingedly mounted to the compartment in which the cards are contained. Rings secured to the cover extend through holes in the cards, and permit the cards to be turned in the manner of the pages of a book. A cover flap extension laterally displaces the cards when the cover is opened.

14 Claims, 12 Drawing Figures

FIG. 1
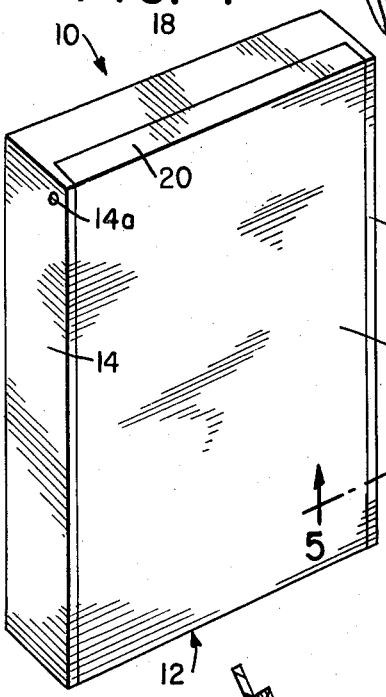
FIG. 2
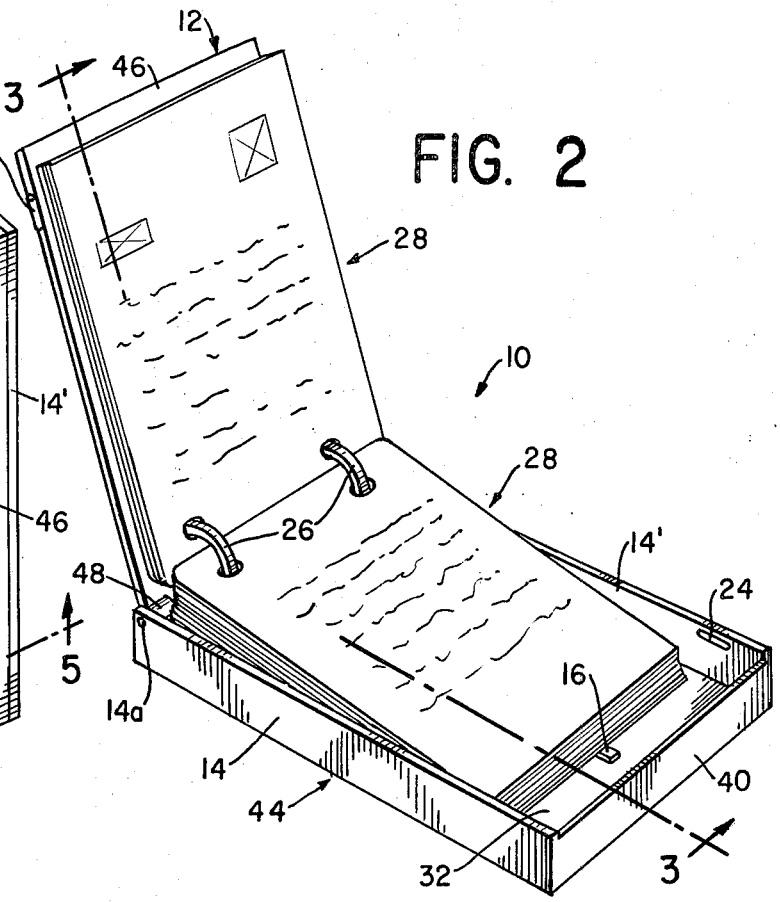
FIG. 5
FIG. 3
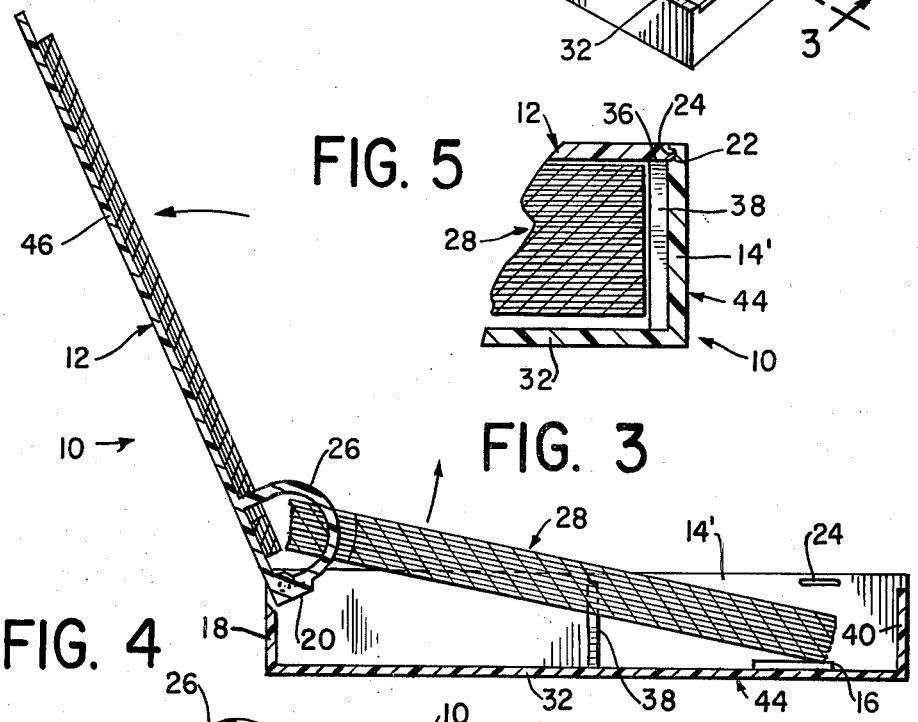
FIG. 4
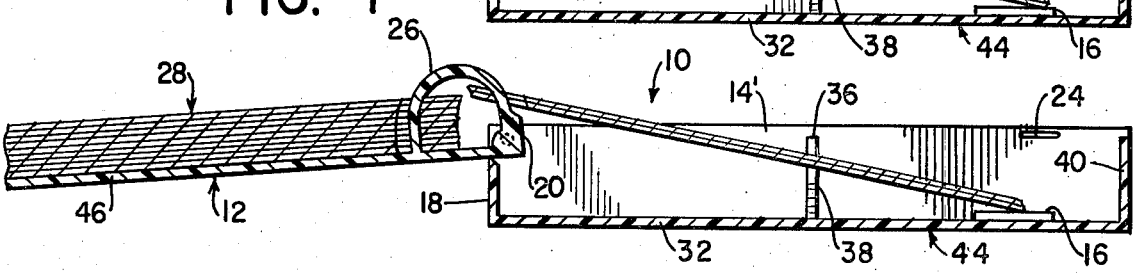

DEVICE FOR HOLDING FLIP CARDS

BACKGROUND OF THE INVENTION

This application is a continuation-in-part of U.S. Design application Ser. No. 873,090, filed Jan. 27, 1978.

The present invention relates generally to card storage and viewing equipment, and specifically concerns a weatherproof device for holding flip cards. The device is compact enough to be hand-held and also sturdy enough to be used without additional support on a table or other flat surface.

It is an object of the present invention to provide a device for holding flip cards which is weathertight.

It is an additional object of the invention to provide a device for holding flip cards which is substantially the same size as the cards and yet allows for easy access to the cards when the case is opened.

It is a further object of the invention to provide a device for holding flip cards which allows for easy viewing of both sides of each card.

In accordance with an illustrative embodiment demonstrating objects and features of the present invention, a box-shaped case of unique construction is provided. The case has a cover which is hingedly mounted to the compartment in which the cards are contained. Rings for retaining the cards are secured to the cover. A cover flap extension permits the cards to be displaced when the cover is opened. The displacement allows enough room for a person to insert one or more fingers into the box to flip the cards in the manner of the pages of a book. Both sides of the cards may be viewed in this manner.

Other objects, features and advantages of the present invention may be understood more completely by reading the following detailed description in connection with the accompanying drawings, in which:

FIG. 1 is a perspective view showing the closed case supported in an upright position;

FIG. 2 is a perspective view showing the case supported in its opened position;

FIG. 3 is a sectional view taken substantially along contour 3—3 of FIG. 2;

FIG. 4 is a sectional view similar to FIG. 3 with the cover shown in its maximally open position;

FIG. 5 is a fragmentary sectional view, on an enlarged scale, taken substantially along line 5—5 in FIG. 1.

DETAILED DESCRIPTION OF THE PREFERRED EMBODIMENT

Figure 6:
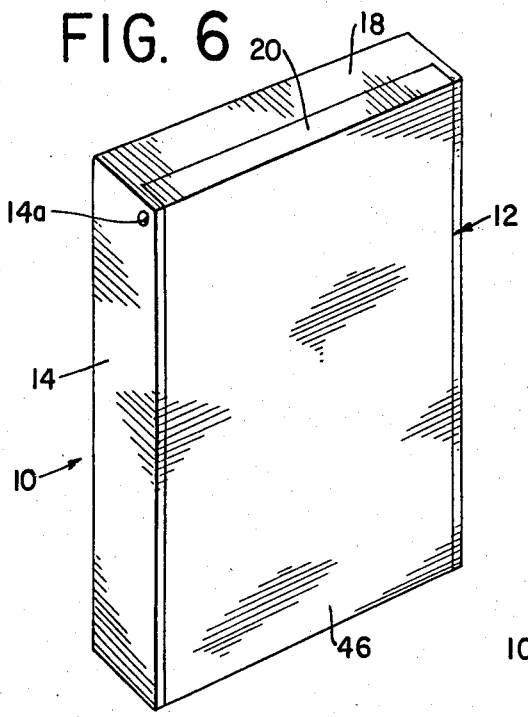
FIG. 6 is a perspective view of the device.

Referring now to the details of the drawing, the invention is directed to a construction for a case 10 for holding flip cards 28. The case 10 has a cover 12 which is hingeably connected at a first edge to compartment 44, which has an open top. Cover 12 is mounted to compartment 44 to close the top.

Cover 12 includes cover top 46, hinge pins 48, rings 26, displacing means 20, and locking protrusions 22. Hinge pins 48 extend outwardly from a point along a first edge of cover 12. The pins 48 are dowel-shaped and protrude past the periphery of cover top 46.

Retaining means in the form of rings 26 are secured to the top surface 46 of cover 12 on the side which is in the interior of case 10 when case 10 is closed. They are secured at a first edge of cover 12 and at a securement position a spaced distance from the first edge along the length of the cover. Each ring 26 is adapted to extend through an aperature in each of the cards 28 to permit the cards 28 to be turned in the manner of the pages of a book.

In the preferred embodiment, displacing means 20 protrude from the same surface of cover 12 as the rings 26. The edge of displacing means 20 may be beveled to provide sealing engagement with compartment 44 as will be explained in more detail below.

Cover 12 also has locking protrusions 22. These locking protrusions 22 are positioned on the periphery of cover 12.

Compartment 44 is made up of bottom wall 32 and at least one side wall which extends upwardly from the bottom wall to form a closed perimeter for the compartment. In the preferred embodiment, bottom wall 32 is rectangular in shape and includes a lifter 16 for cards 28. The perimeter includes side wall 14 and 14', terminal wall 40 and end wall 18. Side walls 14 and 14' are resilient and each have a hole **14*a* near the top corner nearest end wall 18, a center projection 38 extending into the interior of compartment 44, and notches 24. Center projection 38 is shorter than side walls 14 and 14' by a distance equal to the thickness of cover top 46. The top of center projection 38 is center rest surface 36. Terminal wall 40 is the same height as center projection 38 and is the first portion of reduced height. Its top is cover rest surface 36. End wall 18** may be the second portion of reduced height, and may have a beveled edge.

In use, the hinge pins 48 fit into holes **14*a* in side walls 14 and 14' and the cover is hingeably mounted about the axis containing the pins. When cover 12 is closed, the bevels on cover flap extension 20 and end wall 18 are complementary and form a seal. Additionally locking protrusions 22 on cover 12 are aligned with the notches 24 and snap into resilient side walls 14 and 14', thereby acting as a detent means for securing the cover in a locked position. An overlap portion of cover top 46 extends into the first portion of the perimeter which is of reduced height and rests on center rest surface 36 and cover rest surface 30. The exterior surface of cover top 46 lies flush with the top of side walls 14 and 14'**.

When cover 12 is opened, rings 26, which extend through aperatures in cards 28, displace the cards 28 towards end wall 18 and displacing means 20 displaces the cards 28 laterally with respect to compartment 44. This allows room between the unattached ends of the cards 28 and terminal wall 40 for a person to insert their fingers into compartment 44 to flip the cards 28. A lifter 16 supports the cards 28 at the end distant from retaining means 26 and acts as an aid in flipping the cards 28. The cards 28 may be printed on one or both sides and easily viewed.

Figure 7:
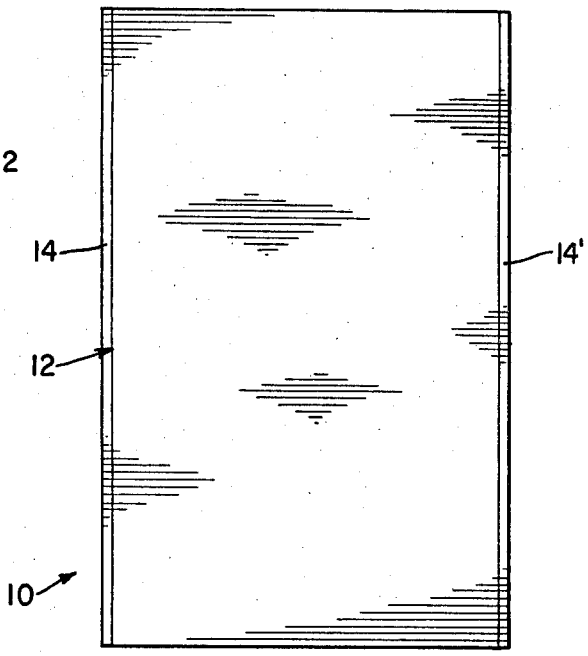
FIG. 7 is a top plan view with respect to FIG. 6.
Figure 8:
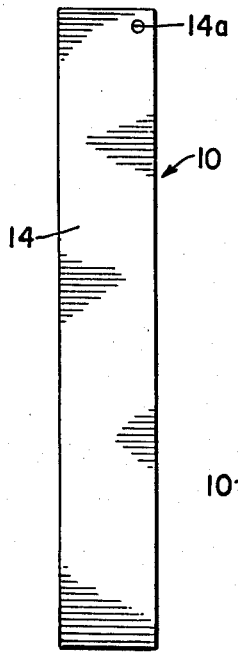
FIG. 8 is a left side elevational view with respect to FIG. 6, the right side elevational view being a mirror image thereof.
Figure 9:
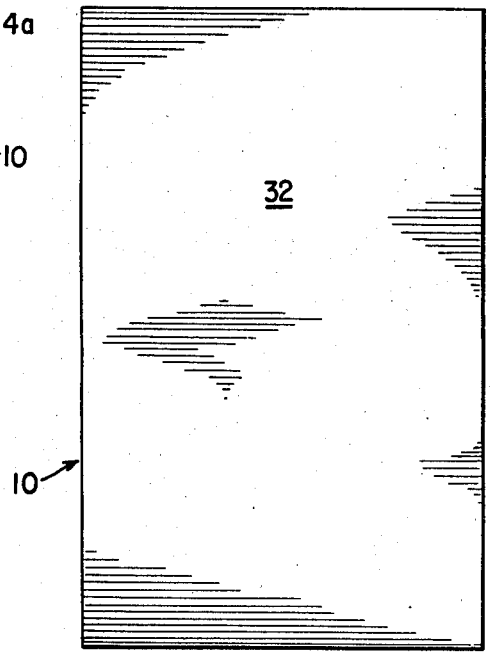
FIG. 9 is a bottom elevational view with respect to FIG. 6.
Figure 10:
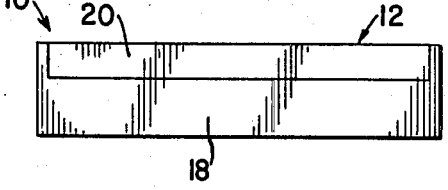
FIG. 10 is a rear elevational view with respect to FIG. 6.
Figure 11:
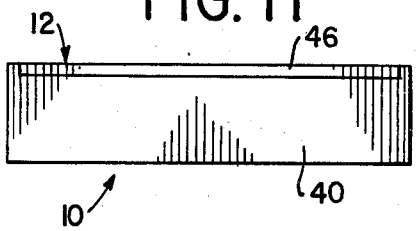
FIG. 11 is a front elevational view with respect to FIG. 6.
Figure 12:
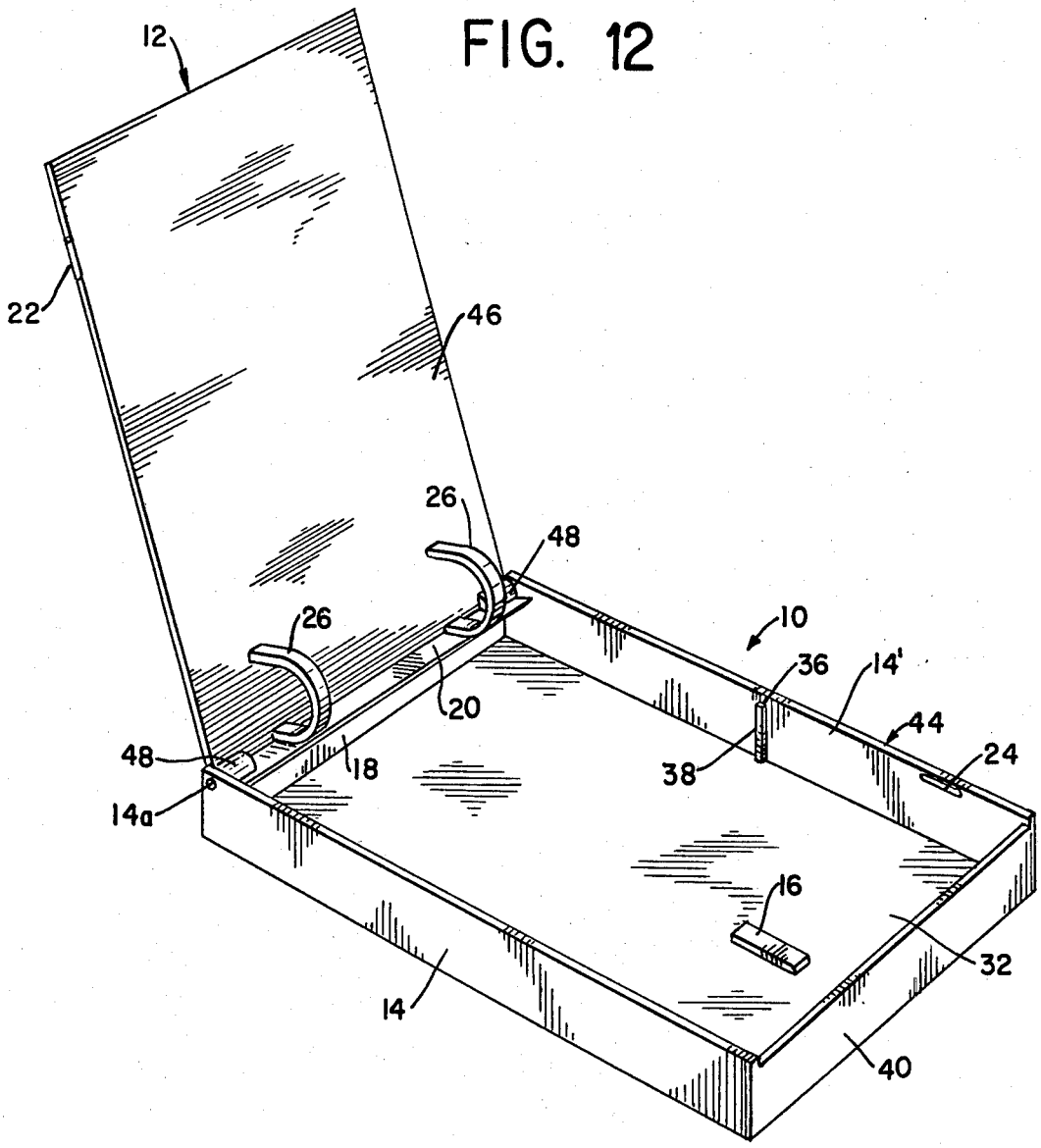
FIG. 12 is a perspective view of the device showing the cover opened.

In a preferred embodiment, case 10 is made of a clear plastic material, and is approximately 4¼ inches in length, $2\frac{3}{4}$ inches in width and $\frac{5}{8}$ inch in height. When made of styrene in the dimensions specified above, case 10 weighs approximately 34 grams (1.2 ounce). A preferred embodiment of the invention looks substantially as shown in FIGS. 6 to 12.

Case 10 containing cards 28 is ideal for many types of activities. For example, it is contemplated that this device may be used for outdoor activities, such as boating or camping trips. Guides or manuals, e.g. a first aid manual, may be printed on cards 28. The case is compact, being only slightly larger than cards 28, lightweight, weathertight, and easily packable, all desirable features in a device which is to be carried on outdoor activities. Alternatively, case 10 may be used to hold recipe cards, photographs, or other similar types of materials. It is also contemplated that case 10 may be stood on a portion of the perimeter and the periphery of cover 12 for viewing cards 28 which are contained within it.

Although the invention has been described in terms of a rectangular embodiment, it will be appreciated by one skilled in the art that the other embodiments in accordance with the present invention may be used. For example, retaining a rectangular embodiment, the cover 12 may be hingedly connected to compartment 44 and the rings 26 may be attached to cover 12 along a long edge in contrast to what is shown in the drawings. In fact, the compartment 44 and cards 28 may be any geometric shape, e.g. triangular, oval, or whatever, and still fall within the scope of the invention. The displacing means 20 need not extend across an entire side of a card 28, but could alternatively be narrow finger-like extensions. Of course the number of rings 26 may be varied as well. What is claimed as new and desired to be secured by Letters Patent of the United States is set out in the accompanying claims.

What is claimed is:

1. In a device for holding flip cards each having a plurality of aligned apertures near one edge;

a cover hingedly mounted, at a first edge thereof, with respect to the remainder of said device, whereby said cover may be moved between a closed and a fully open position;

retaining means secured to said cover near said first edge and at a securement position spaced from said first edge along the length of said cover, said retaining means defining at least one protruding ring, each ring being adapted to extend through an aperture in each of said cards to permit the card to be turned in the manner of a page of a book; and displacing means disposed near said first edge and actuated when said cover is moved toward said fully open position for withdrawing part of each card from said remainder of said device while permitting part of each card to remain in such remainder, at least a portion of said displacing means being spaced from said cover in the protruding direction of said retaining means, said protion engaging at least one of said cards and moving away from said remainder of said device as said cover is moved towards said fully open position.

2. A device in accordance with claim 1 wherein said remainder comprises compartment with an open top, said cover being hingedly mounted thereto so as to close said top.

3. A device according to claim 2 wherein said compartment comprises a bottom wall and at least one side wall extending upwardly therefrom to form a substantially closed perimeter for said compartment, said perimeter having a first portion which is of a lesser height than the remainder of said perimeter by at least the thickness of said cover, said cover being shaped to be substantially surrounded by said perimeter and to be flush with the upper edge thereof when closed, said cover having an overlap portion which extends into the reduced height portion of said perimeter, whereby said container is effectively sealed.

4. A device according to claim 3 wherein said perimeter includes a second portion of reduced height, said cover being mounted so that said means for laterally displacing extends into said second reduced height portion when said cover is closed, said means for laterally displacing being substantially flush to said perimeter when said cover is closed.

5. A device according to claim 4 wherein said perimeter and said means for laterally displacing include complementary means for sealingly closing said device.

6. A device according to claim 5 wherein said complementary means are oppositely slanted bevels disposed on confronting edges of said perimeter and said means for laterally displacing.

7. A device according to any of claims 3, 4, 5, or 6 wherein spaced locations on the periphery of said cover and respective locations near the upper edge of said perimeter include complementary components defining detent means for securing said cover in its closed position.

8. A device according to any of claims 3, 4, 5, or 6 wherein said bottom wall is generally rectangular in shape and said perimeter includes four side walls extending upwardly from said bottom wall to form a compartment with an open top.

9. A device according to claim 7 wherein said bottom wall is generally rectangular in shape and said perimeter includes four side walls extending upwardly from said bottom wall to form a compartment with an open top.

10. A device according to any of claims 3, 4, 5, or 6 wherein said bottom wall includes a lifter which supports the cards at the end distant from the retaining means.

11. A device according to any of claim 7, wherein said bottom wall includes a lifter which supports the cards at the end distant from the retaining means.

12. A device according to any of claim 8, wherein said bottom wall includes a lifter which supports the cards at the end distant from the retaining means.

13. A device according to any of claim 9, wherein said bottom wall includes a lifter which supports the cards at the end distant from the retaining means.

14. A device according to claim 1, wherein said device is made of plastic.

* * * * *